United States Patent [19]

Brooks, III.

[11] Patent Number: 5,060,796

[45] Date of Patent: Oct. 29, 1991

[54] MOUNTING APPARATUS FOR GOLF CLUBS

[76] Inventor: Jack N. Brooks, III., 546 W. Morris Ave., Fresno, Calif. 93704

[21] Appl. No.: 569,719

[22] Filed: Aug. 20, 1990

[51] Int. Cl.[5] ..... A63B 55/04; A63B 55/06

[52] U.S. Cl. ..... 206/315.6

[58] Field of Search ..... 206/315.6

[56] References Cited

U.S. PATENT DOCUMENTS

| | | | |
|---|---|---|---|
| 2,781,072 | 2/1957 | Kouke II. | 206/315.6 |
| 2,860,679 | 11/1958 | Kouke | 206/315.6 |
| 3,980,115 | 9/1976 | Longo | 206/315.6 |
| 3,985,229 | 10/1976 | Maki | 206/315.6 |
| 4,194,547 | 3/1980 | Sidor et al. | 206/315.6 |
| 4,241,774 | 12/1980 | Pell | 206/315.6 |
| 4,750,617 | 6/1988 | Anderson et al. | 206/315.6 |
| 4,915,221 | 4/1990 | Spangler | 206/315.6 |
| 4,944,396 | 7/1990 | Larkin | 2065/315.7 |

*Primary Examiner*—William I. Price

*Attorney, Agent, or Firm*—Worrel & Worrel

[57] ABSTRACT

An apparatus for mounting a work object in substantially fixed relation in a predefined area, the apparatus having a substantially planar member adapted to confine the work object therein, a second member adapted to retain the second member in substantially fixed relation to the predefined area; and a fastener for interlocking the planar member and the second member.

8 Claims, 3 Drawing Sheets

MOUNTING APPARATUS FOR GOLF CLUBS

BACKGROUND OF THE INVENTION

1. Field of the Invention

The present invention relates to a mounting apparatus and more particularly to a mounting apparatus which is uniquely well suited to the securing of a plurality of golf club tubes or the like in a predetermined array within a golf bag of virtually any type so as to retain the golf club tubes in substantially fixed relation in the array without the problems associated with conventional devices adapted for the same broad purpose.

2. Description of the Prior Art

There is a host of situations in which a plurality of individual work objects are to be retained in a predefined array within a predefined area. One such environment has been the subject of considerable prior art effort. The game of golf is renown in the affinity of people who play golf for various devices which may assist in improving performance or may serve to improve the comfort or ease with which the game is played. In this respect, for example, and constituting an environment within which the mounting apparatus of the present invention has application, it is widely accepted to employ golf club tubes within golf bags which are individually adapted to receive a golf club. Such golf club tubes serve to organize the interior of the golf bag, to protect the shaft and grip of each club from damage and to prevent the golf clubs from becoming entangled with each other or with other objects during use.

A variety of prior art devices have been developed for mounting such golf club tubes within golf bags, but such prior art devices have, in many respects, been less than satisfactory. The Pell U.S. Pat. No. 4,241,774 discusses a number of these prior art devices. The Pell patent is itself directed to a golf club separator insert which is characterized by a polyethylene foam disc having a plurality of holes individually adapted to receive the golf club tubes and itself adapted to be compressibly mounted in the upper portion of a golf bag in which it is mounted. The device of the Pell patent is notable in its usage of perforated lines spaced successively inwardly from the periphery of the disc operable to permit portions of the periphery of the disc to be broken away for mounting in golf bags of smaller internal diameters than the normal diameter of the disc. While the device of the Pell patent is superior to other prior art devices in certain respects, such prior art devices in general are plagued by operational deficiencies which detract from their utility.

Conventional devices are particularly susceptible to having the golf club tubes individually released therefrom, particularly where, over time, a degree of play develops between the device and the golf club tubes. In other instances, the device itself is easily loosened from the interior of the bag causing the device, the golf club tubes and the golf clubs disposed therewithin to be released from the bag. Frequently during game play, if the golf club bag is dropped or otherwise forcibly impacted against another object, the bag deforms sufficiently to cause the device itself to be deformed and thereby to be released from the golf bag. Other problems reside in the lack of durability inherent in the device making it susceptible to failure as the result of the abusive usage sometimes inherent in the playing of the game.

Therefore, it has long been known that it would be desirable to have a mounting apparatus particularly well suited to the mounting of golf club tubes within a golf bag, which can be constructed at the time of manufacture as an integral part of the golf bag or which can be retrofitted into existing golf bags, which operates positively to capture the golf club tubes relative to the apparatus during the entire period of use of the device, which is adaptable to fit golf bags of virtually any internal diameter, and which is very lightweight but which is securely retained in the golf bag once installed through a long operational life and not withstanding the abusive treatment commonly associated with the playing of the game of golf.

SUMMARY OF THE INVENTION

Therefore, it is an object of the present invention to provide an improved mounting apparatus having particular utility in mounting golf club tubes within golf bags.

Another object is to provide such a mounting apparatus which can be manufactured as an integral part of golf bags or can be retrofitted into existing golf bags of virtually any interior diameter without requiring professional installation.

Another object is to provide such a mounting apparatus which is operable permanently to secure a plurality of golf club tubes in a predefined array in the device in such a fashion as to be capable of withstanding abusive treatment over a long operational life.

Another object is to provide such a mounting apparatus which is substantially impervious to inadvertent release from its installed position.

Another object is to provide such a mounting apparatus which can be adjusted to fit the interior diameters of golf bags of virtually any size and even where of an asymmetric configuration without substantial effort and yet which, once installed, is thereafter dependably operable to perform all of the benefits associated with the mounting apparatus.

Another object is to provide such a mounting apparatus which includes a receptacle dimensioned to receive a golf club or ball retriever having even the largest head portion.

Another object is to provide such a mounting apparatus which has a pleasing aesthetic appearance once installed which is entirely compatible with that of the golf bag.

Another object is to provide such a mounting apparatus which operates as a barrier to prevent the introduction of extraneous material to the interior of the golf bag.

These and other objects and advantages are achieved, in the preferred embodiment of the present invention, in an apparatus having a substantially planar member adapted to confine a work object relative therein, a second member adapted to retain the second member in substantially fixed relation in the predefined area; and a fastener for interlocking the planar member and the second member.

DESCRIPTION OF THE PREFERRED EMBODIMENT

Figure 1:
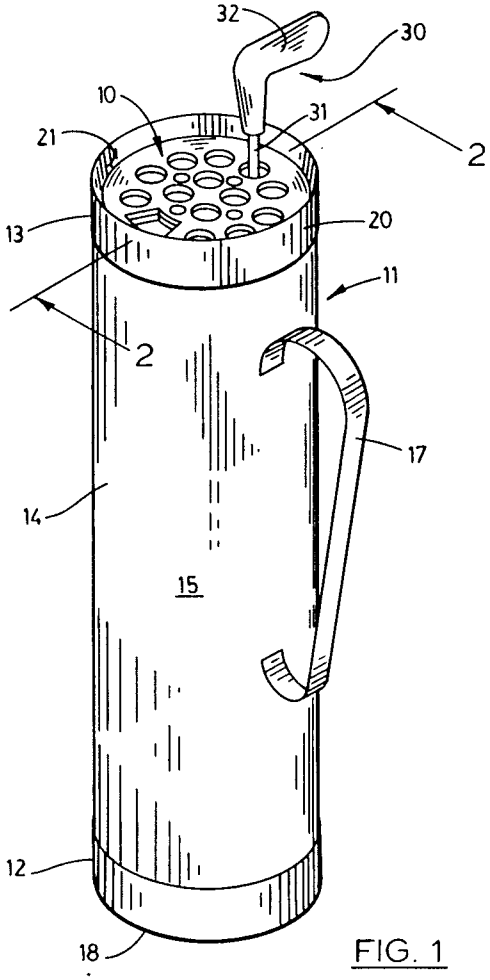
FIG. 1 is a perspective view showing the mounting apparatus of the present invention installed in a typical operative environment in a golf bag.

Referring more particularly to the drawings the mounting apparatus of the present invention is generally indicated by the numeral 10 in FIG. 1. As shown in FIG. 1, the mounting apparatus is employed in a typical operative environment in position in a conventional golf bag 11. The golf bag has a base end portion 12 and an opposite upper end portion 13. The golf bag has a cylindrical side wall 14 having an exterior surface 15 and an interior surface 16. A strap 17 is mounted on the cylindrical side wall. The golf bag has a bottom cap portion 18 fitted over the base end portion 12 of the cylindrical side wall. The bottom cap portion has an interior surface 19. The golf bag has an upper annular cap portion 20, shown best in FIG. 2 which is fitted over the upper end portion 13 of the cylindrical side wall 14. The upper annular cap portion has a throat or interior surface 21 which is substantially cylindrical. In the conventional fashion, the upper annular cap portion is constructed of a substantially rigid material such as plastic. The golf bag has an interior 22.

Figure 2:
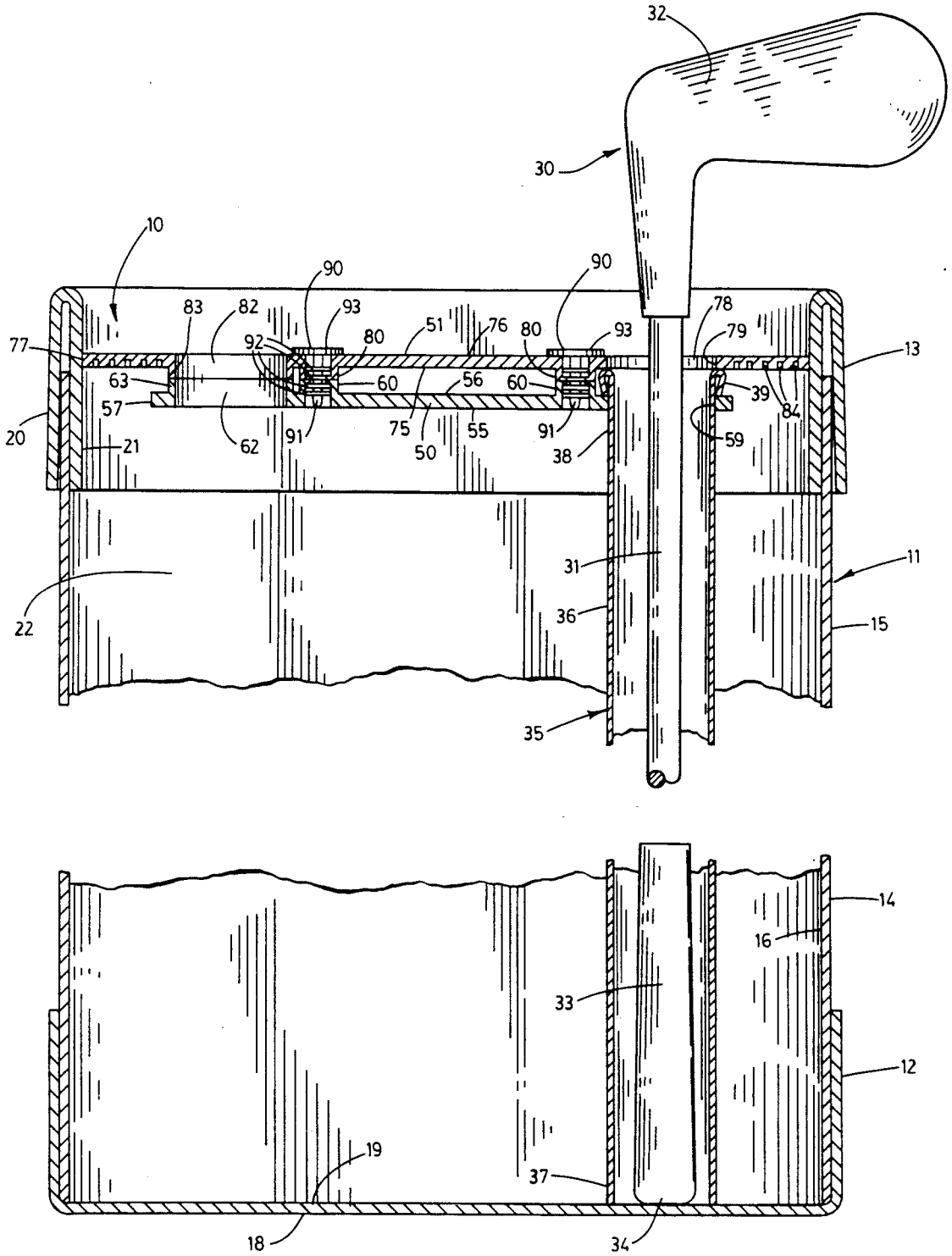
FIG. 2 is a somewhat enlarged, fragmentary, longitudinal section taken on line 2—2 in FIG. 1.

As shown in FIGS. 1 and 2, a golf club 30 is positioned in a typical attitude in the golf bag 11 mounting the mounting apparatus 10. The golf club has a shaft 31, a head 32 and a grip 33. The grip has an end portion 34. As shown best in FIGS. 2 and 3, a conventional golf club tube 35 is mounted in position in the mounting apparatus of the present invention, as will hereinafter be described in greater detail. The golf club tube has a cylindrical side wall 36 having a lower end portion 37 and an upper end portion 38. The golf club tube, in the conventional manner, is constructed of a rigid plastic material and the upper end portion 38 of the golf club tube is rolled outwardly to form a rolled lip 39.

The mounting apparatus 10 includes two main operative portions, those being a first or lower plate 50 and a second or upper plate 51. The plates are preferably constructed of a rigid plastic material and are of substantially planar construction having an over all disc like configuration.

The lower plate 50 has a lower surface 55 and an opposite upper surface 56. The lower plate has a substantially circular peripheral edge 57. A plurality of circular holes 58 are extended through the lower plate each defined by a circular annulus 59 bounding the hole. The diameter of each annulus 59 is slightly greater than the diameter of the side wall 36 of each of the golf club tubes 35 so that each of the golf club tubes can slidably be extended through one of the circular holes. Four cylindrical projections 60 extend upwardly from the upper surface 56 of the lower plate a common predetermined distance, as can best be seen in FIG. 2. Each of the cylindrical projections has a fastening hole 61 extending from the lower surface 55 entirely through the cylindrical projection and out the terminal end portion thereof.

Figure 3:
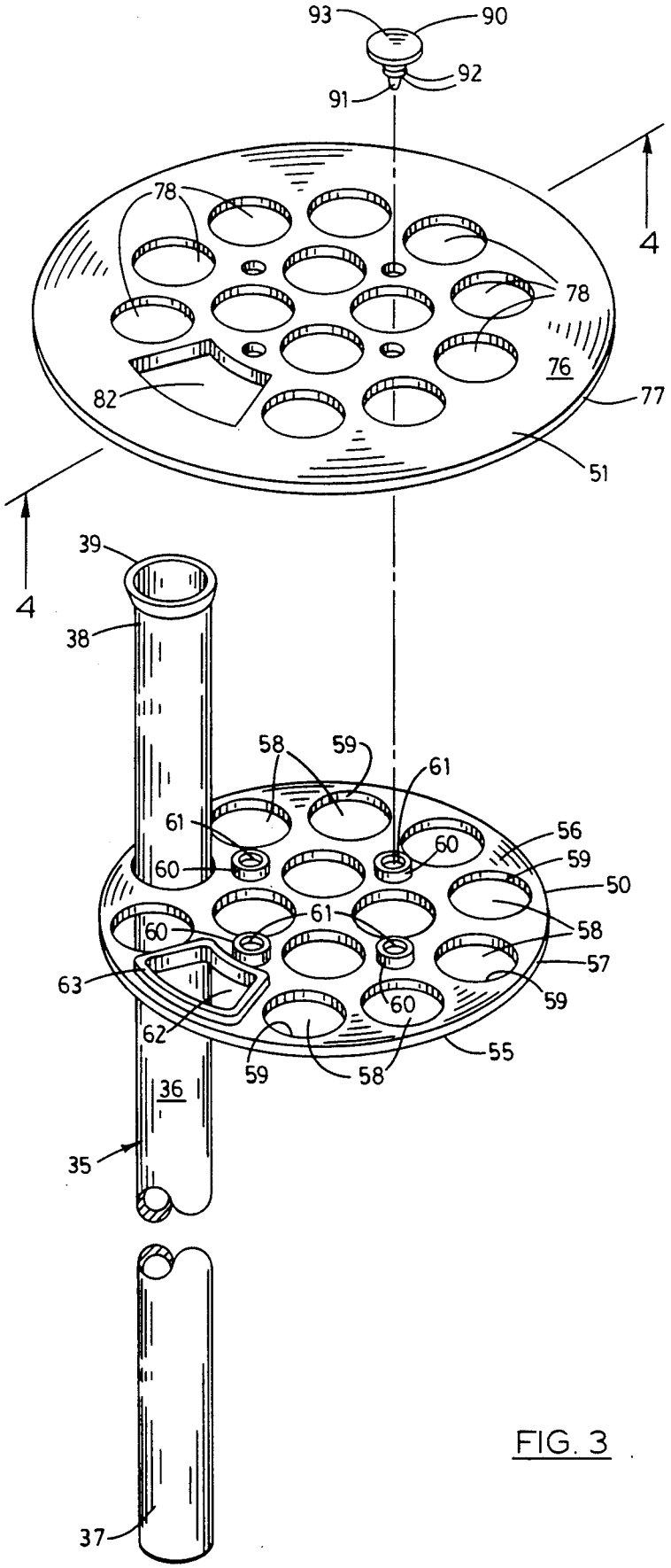
FIG. 3 is a fragmentary, perspective exploded view of the mounting apparatus disposed in a relationship such as conveniently to illustrate the method by which the apparatus is assembled.

The lower plate 50 has an angular opening 62 preferably having the configuration best shown in FIG. 3 and is bounded by a ridge 63 extending upwardly from the upper surface 56 of the lower plate the same distance as the cylindrical projections 60.

The upper plate 51 has a lower surface 75 and an opposite upper surface 76. The upper plate has a substantially circular peripheral edge 77 of greater diameter than that of the lower plate 50, as can perhaps best be seen in FIG. 2. A plurality of circular holes 78 each defined by a circular annulus 79 extend through the upper plate in the precise same pattern as the pattern of the plurality of circular holes 58 of the lower plate. The diameters of the holes 58 and 78 are preferably identical. Four cylindrical projections 80 are mounted on and extend downwardly from the lower surface 75 of the upper plate in precisely the same pattern as the cylindrical projections 60 and preferably extend the same distance from the lower surface 75 as the cylindrical projections 60 extend from the upper surface 56 of the lower plate. A fastening hole 81 extends through each of the cylindrical projections 80 from the upper surface 76 through the cylindrical projection and outwardly through the terminal end of the cylindrical projection.

Figure 4:
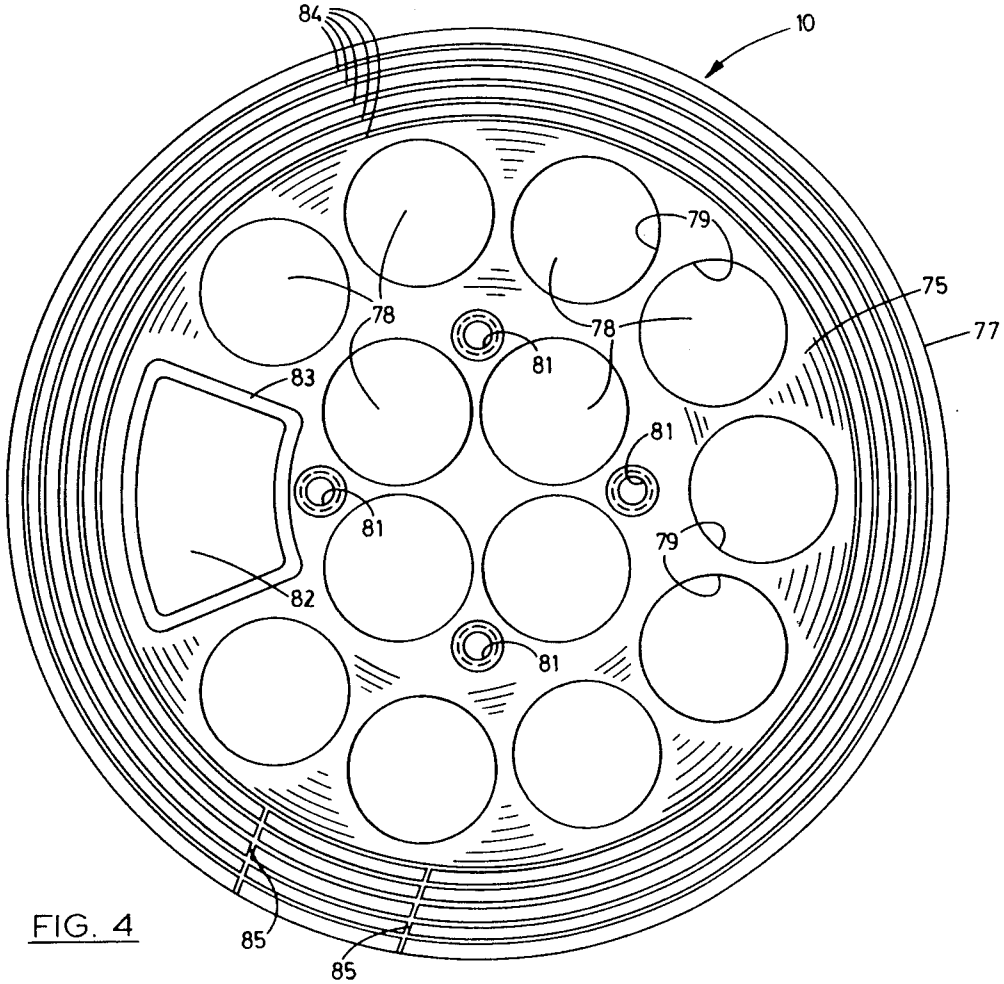
FIG. 4 is a somewhat enlarged, bottom plan view of the upper plate of the mounting apparatus taken on line 4—4 in FIG. 3.

The upper plate 51 has an angular opening 82 matching that of the angular opening 62 of the lower plate 50 and bounded by a ridge 83 extending downwardly from the lower surface 75 of the upper plate the same distance as that of the cylindrical projections 80 and thus the same distance as the ridge 63 extends upwardly from the upper surface 56 of the lower plate 50. A plurality of concentric circular grooves 84 are formed in the lower surface 75 of the upper plate extending inwardly thereof a distance as can best be visualized in FIG. 2 such as to constitute weakened courses for purposes subsequently to be described. As shown in FIG. 4, a pair of radial grooves 85 are formed in the lower surface 75 extending inwardly from the peripheral edge 77 across the circular grooves 84.

Four fasteners 90, preferably of the same plastic material as that from which the lower plate 50 and upper plate 51 are constructed, are employed to interlock the lower plate and upper plate as will hereinafter be described. Each of the fasteners has a shaft 91 about which are extended radially extending flanges 92. A cap 93 is mounted on each shaft. The radially extending flanges have diameters slightly greater than the internal diameters of the fastening holes 61 and 81.

OPERATION

The operation of the described embodiment of the subject invention is believed to be clearly apparent and is briefly summarized at this point. The mounting apparatus 10 can be constructed as an integral part of a golf bag 11 at the time of manufacture or can be retrofitted into virtually any existing golf bag. For purposes of illustrative convenience, the assembly of the mounting apparatus, when being retrofitted to an existing golf bag, is hereinafter described.

The mounting apparatus 10 is employed to install and retain a plurality of golf club tubes 35 in the golf bag 11. Installation is achieved by extending each of the golf club tubes through one of the circular holes 58 in the lower plate 50 sliding it downwardly therethrough until the rolled lip 39 engages the upper surface 56 of the lower plate, as shown in FIG. 2.

When all of the golf club tubes have been so positioned, the upper plate 51 is positioned in overlaying relation to the lower plate 50 so that the end portions of the cylindrical projections 60 and 80 and of the ridges 63 and 83 are positioned in abutted engagement, as shown in FIG. 2. Since the lower and upper plates are constructed as described, this individually positions the plurality of circular holes 58 in alignment with their corresponding circular holes 78. The four fasteners 90 are then individually pressed downwardly through the fastening holes 81 of the cylindrical projections 80 of the upper plate 51 and into the fastening holes 61 of the cylindrical projections 60. The radially extending flanges 92 snap fit within the fastening holes of the projections so as to interlock the plates in substantially permanent engagement in the manner heretofore described.

As can best be visualized upon reference to FIG. 2, since the upper surface 76 of the lower plate 50 engages the rolled lip 39 of each golf club tube and the lower surface 75 of the upper plate 51 engages the upper surface of the rolled lip 39 of each golf club tube, the golf club tubes are permanently secured in position individually within the circular holes 58 and 78 and interlocked with the lower and upper plate to form a single integral unit.

The lower end portions 37 of the golf club tubes are then disposed inwardly of the interior 22 of the golf bag 11 and moved downwardly until the lower end portions 37 of the golf club tubes engage the interior surface 19 of the bottom cap portion 18 of the golf bag. During the last several inches of movement of the golf club tubes within the interior of the golf bag, the lower plate 50 and upper plate 51 slide within the upper annular cap portion 20, as shown in FIG. 2. The peripheral edge 77 of the upper plate 51 is, as shown in FIG. 2, substantially the same diameter as the interior surface 21 of the upper annular cap portion. The mounting apparatus 10 is suppressed downwardly so that the mounting apparatus is forcibly fitted within the upper annular cap portion and is held in position by compressive engagement between the upper annular cap portion and the peripheral edge of the upper plate. The rigidity of the upper plate is such that it does not appreciably deform under such pressure. If the length of the golf club tubes is such that they are too long to achieve the relationship shown in FIG. 2, the lower end portions 37 thereof are cut off a sufficient length so that this relationship can be achieved. Preferably the lower end portions are disposed in abutted engagement with the interior surface 19 of the bottom cap portion 18 of the golf bag when the mounting apparatus is mounted as shown in FIG. 2 so that the golf bag, mounting apparatus and golf club tubes form an integral unit.

Where the upper annular cap portion 20 of the particular golf bag 11 has a smaller diameter interior surface 21, the installation can be similarly achieved by running a sharpened instrument such as a knife in the appropriate circular groove 84 to allow the outer portion of the upper plate to be removed. Thereby, in effect, the upper plate is provided with a smaller diameter peripheral edge which is suitable for being forcibly fitted within the upper annular cap portion. In some golf bags, the interior surface 21 of the upper annular cap portion 20 is not precisely cylindrical. This occurs, for example, where the structure of the strap 17 must be accommodated in part by the interior surface 21 so as to form a flattened portion or actually to extend slightly inwardly of the interior of the golf bag. Where this structure is present, the installation is varied only by the running of a sharpened instrument from the peripheral edge 77, or from the appropriate concentric circular groove 84, inwardly along one of the radial grooves 85 and along an appropriate smaller diameter circular groove 84 to the other radial groove 85 at which point the sharpened instrument is again moved outwardly along that radial groove. This permits the peripheral edge to be broken off so as to form a notch to accommodate the flattened or inwardly extending portion of the interior surface 21 of the upper annular cap portion 20.

Therefore, the mounting apparatus of the present invention provides an inexpensive, convenient, durable and permanent structure for retaining golf club tubes within a golf bag in a predefined array which is adaptable to virtually any golf club bag, which can be installed at the time of manufacture or retrofitted in existing golf bags, and which dependably forms an integral unit with the golf club tubes and the golf bag so as substantially to prevent inadvertent release of the golf club tubes from the golf bag.

Although the invention has been herein shown and described in what is conceived to be the most practical and preferred embodiment, it is recognized that departures may be made therefrom within the scope of the invention which is not to be limited to the illustrative details disclosed.

Having described my invention, what I claim as new and desire to secure by Letters Patent is:

1. An apparatus for mounting a work object in substantially fixed relation in a predefined area having a substantially rigid, substantially circular boundary, the apparatus comprising a substantially planar first member having a passage extending therethrough bounded by a peripheral edge coextensive with the first member adapted laterally to capture the work object when extended therethrough; a substantially planar second member having means for retaining the second member in substantially fixed relation in said predefined area including a peripheral edge dimensioned resistively to interfit with said substantially circular boundary and said retaining means further including a plurality of substantially concentric weakened courses substantially concentric to said peripheral edge to permit the peripheral edge selectively to be separated from the second member in a selected width to form a new peripheral edge for said second member resistively to interfit with a smaller substantially circular boundary; and means for interlocking the first member and the second member.

2. The apparatus of claim 1 wherein said retaining means further includes a pair of substantially weakened courses substantially radially extending from the peripheral edge of the second member across said substantially concentric weakened courses in spaced relation to each other with said substantially concentric weakened courses to define an area of the second member to permit the peripheral edge selectively to be separated from the second member so as to form said new peripheral edge with a recessed portion of selected depth.

3. An apparatus for mounting a substantially tubular work object, having an end portion circumscribed by an enlarged portion, in substantially fixed relation in a predefined area, the apparatus comprising a substantially planar first member having an opening defined by a boundary with a transverse dimension adapted slidably to interfit with said work object and to abut said enlarged portion, a second member having means for retaining the second member in substantially fixed relation in said predefined area and the second member having an opening defined by a boundary with a transverse dimension adapted to abut said enlarged portion of the work object on the opposite side thereof from the first member so as to capture said enlarged portion of the work object between the first member and the second member and thus the work object in said substantially fixed relation to the predefined area; and means for interlocking the first member and the second member.

4. The apparatus of claim 3 wherein said interlocking means includes at least a pair of fasteners individually adapted to be driven into the first member and the second member to interlock the first member with the second member with the enlarged portion of the work object therebetween.

5. An apparatus for mounting a plurality of golf club tubes, individually having predetermined outside diameters and upper end portions circumscribed by outwardly rolled lip portions of predetermined outside diameters, in a predefined array in a golf bag, having a substantially rigid tubular upper end portion defining a substantially cylindrical throat for the golf bag, the apparatus comprising:

A. a first plate having a plurality of substantially circular openings each defined by a marginal edge substantially conforming to said outside diameter of each of the golf club tubes and smaller than the outside diameters of the rolled lip portions thereof, and at least a pair of projections extending upwardly from a common face of the first plate and having openings in terminal ends thereof;

B. a second plate having a plurality of openings each having a transverse dimension smaller than said outside diameter of said lip portions of the golf club tubes, a peripherical edge adapted resistively to interfit with said substantially cylindrical throat of the golf bag, and at least a pair of projections extending upwardly from a common face of the second plate in positions corresponding to those of said projections of the first plate and having openings in terminal ends thereof; and C. at least a pair of fasteners dimensioned, when the first and second plates are disposed with said common faces thereof in juxtaposition and said corresponding projections individually in endwardly aligned abutted relation and with said golf club tubes individually extending through the openings of the first plate with the lip portions of said golf club tubes captured between said first and second plates with said openings of the second plate individually aligned with the golf club tubes, individually to be extended through said openings of the projections of the first and second plates to interlock the first and second plates and capture the golf club tubes in said predefined array.

6. The apparatus of claim 1 wherein the first and second plates both have secondary openings of substantially the same configuration and disposed in corresponding positions relative to said projections of the first and second plates and bounded by ridges extending outwardly from said common faces of the first and second plates and wherein the height of said ridges and said projections of the first and second plates is substantially identically whereby when the first and second plates are interlocked said corresponding ridges and projections of the first and second plates endwardly engage each other and said first and second plates are disposed in substantially parallel relation.

7. The apparatus of claim 6 wherein said common face of the second plate has a plurality of substantially concentric grooves extending inwardly thereof substantially concentric to said peripheral edge to permit the peripheral edge selectively to be separated from the second member in a selected width to form a new peripheral edge for said second member resistively to interfit with a throat of a golf bag of smaller diameter.

8. The apparatus of claim 7 including a pair of linear grooves extending inwardly of said common face of the second plate along courses intersecting said substantially concentric grooves in spaced relation to each other to permit the peripheral edge of the second plate to be separated so as to form a recess of selected depth to conform to said throat of the golf bag.

* * * * *